US009520025B2

(12) United States Patent
Koyama et al.

(10) Patent No.: US 9,520,025 B2
(45) Date of Patent: Dec. 13, 2016

(54) GAMING SYSTEM

(75) Inventors: Toshimi Koyama, Tokyo (JP); Jun Fujimoto, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 538 days.

(21) Appl. No.: 12/706,076

(22) Filed: Feb. 16, 2010

(65) Prior Publication Data

US 2010/0210355 A1 Aug. 19, 2010

(30) Foreign Application Priority Data

Feb. 17, 2009 (JP) ..... 2009-033466

(51) Int. Cl.

| | |
|---|---|
| ***A63F 9/24*** | (2006.01) |
| ***A63F 3/00*** | (2006.01) |
| ***G07F 17/32*** | (2006.01) |
| ***G07F 1/06*** | (2006.01) |

(52) U.S. Cl.

CPC ..... *G07F 17/3251* (2013.01); *G07F 1/06* (2013.01); *G07F 17/32* (2013.01); *G07F 17/322* (2013.01); *G07F 17/3232* (2013.01); *A63F 3/00157* (2013.01); *G07F 17/3248* (2013.01)

(58) Field of Classification Search

CPC .... G07F 17/322; G07F 17/3251; G07F 17/32; G07F 17/3248; A63F 3/00157; A63F 2009/2489

USPC ..... 463/25; 273/237

See application file for complete search history.

(56) References Cited

U.S. PATENT DOCUMENTS

| | | | | |
|---|---|---|---|---|
| 5,651,548 | A | 7/1997 | French et al. | |
| 2004/0137977 | A1 | 7/2004 | Fujimoto | |
| 2004/0219982 | A1 | 11/2004 | Khoo et al. | |
| 2004/0229682 | A1* | 11/2004 | Gelinotte | 463/25 |
| 2006/0258427 | A1* | 11/2006 | Rowe et al. | 463/16 |
| 2006/0287068 | A1* | 12/2006 | Walker et al. | 463/25 |
| 2008/0009339 | A1* | 1/2008 | Pat et al. | 463/25 |

(Continued)

FOREIGN PATENT DOCUMENTS

| | | |
|---|---|---|
| CN | 1155713 A | 7/1997 |
| EP | 1 431 938 A2 | 6/2004 |

(Continued)

OTHER PUBLICATIONS

International-Style Search Report and Office Action issued Jul. 4. 2011 in Macau Application No. I/1019 (With English Translation).

(Continued)

*Primary Examiner* — Damon Pierce

(74) *Attorney, Agent, or Firm* — Lex IP Meister, PLLC

(57) ABSTRACT

A gaming system is provided enabling real-time cash management to be performed, even while in the play of a game to be performed by employing game media rendering their items of recorded information readable. Having received a result of detection of game chips on a game betting board from a game betting device, a server device accumulates the result of the detection, and judges whether or not movement of game chips has occurred between a dealer and each player, in comparison with a past result. When movement of game chips has occurred between the dealer and such each player, data relevant to a game chip table, a player table, and a dealer table is updated so as to reflect a result of the movement.

6 Claims, 17 Drawing Sheets

(56) References Cited

U.S. PATENT DOCUMENTS

2008/0161104 A1 7/2008 Fujimoto

FOREIGN PATENT DOCUMENTS

| | | |
|---|---|---|
| JP | 2003-144747 | 5/2003 |
| JP | 2005-309864 | 11/2005 |
| JP | 2005-342175 | 12/2005 |
| JP | 2006-338230 | 12/2006 |
| JP | 2008-142452 | 6/2008 |
| JP | 2009-018021 | 1/2009 |
| WO | WO 97/27526 | 7/1997 |

OTHER PUBLICATIONS

Office Action of the corresponding Japanese application (Japanese Patent Application No. 2009-033466) (Mar. 12, 2013).

* cited by examiner

Fig. 11

GAME CHIP TABLE

111

| NUMBER | CHIP ID | CARD ID | TERM OF VALIDITY |
|---|---|---|---|
| 1 | 12345 | 99999 | 09.12.31 |
| 2 | 23456 | 88888 | 10.06.30 |
| 3 | 34567 | 77777 | 09.12.31 |
| ⋮ | ⋮ | ⋮ | ⋮ |

Fig. 13

DEALER TABLE 113

| CARD ID: abcde | | |
|---|---|---|
| - NUMBER OF BILLS BY CASH TYPE | 10-DOLLAR BILL | 53 |
| | 5-DOLLAR BILL | 61 |
| | 1-DOLLAR BILL | 94 |
| - TOTAL AMOUNT: 929 DOLLARS | | |
| - CURRENT POSITION: BLACKJACK A | | |
| - 34567 - 5 DOLLARS | | |
| 45678 - 5 DOLLARS | | |
| ⋮ | ⋮ | |

Fig. 14

CASH TYPE TABLE 114

| NUMBER | CHIP ID | CASH TYPE |
|---|---|---|
| 1 | 12345 | 10 DOLLAR BILL |
| 2 | 23456 | 10 DOLLAR BILL |
| 3 | 34567 | 5 DOLLAR BILL |
| 4 | 45678 | 5 DOLLAR BILL |
| 5 | 56789 | 1 DOLLAR BILL |
| ⋮ | ⋮ | ⋮ |

GAMING SYSTEM

CROSS-REFERENCE TO RELATED APPLICATIONS

This application is based upon and claims a priority from the prior Japanese patent Application 2009-033466 filed on Feb. 17, 2009, the entire contents of which are incorporated herein by reference.

BACKGROUND OF THE INVENTION

1. Field of the Invention

The present invention relates to a gaming system.

2. Related Art

In casinos, players pay cash in cash exchange locations or the like, receive chips to which negotiable values for using games are imparted, and bet the chips to play games. The players then exchange the chips into cash after the completion of the games.

In recent years, there has been known a system of employing chips having IC tags provided therein to identify the IC tags by means of data which is obtained by reading the chips, allowing a server to manage actions performed by gaming machines as data (refer to Patent Document 1, i.e., Japanese Laid-open Patent Application No. 2005-342175). Patent Document 1 describes the related art in which chips having IC tags provided therein and a reader section for reading the chips are provided, and automatic computation and prevention of illegal act, in card games of casinos, are performed based upon the read data.

In addition, there is also known the related art of managing records via a server when chips having such negotiable values recorded therein are exchanged into cash (refer to Patent Document 2, i.e., Japanese Laid-open Patent Application No. 2006-338230). The above related art is directed to a system comprising a game machine, a management server, and the system having the management server being adapted to receive sales and paybacks, and to compute sales, a gross profit, an amount of tax, and an absolute profit of the casino game machine, the database being adapted to store computation results obtained by the management server.

SUMMARY OF THE INVENTION

However, in conventional systems employing chips having negotiable values recorded therein, cash management was not made via servers except when chips are exchanged for cash in a cash exchange location or the like, after the completion of games, and real-time cash management could not be performed while in the play of games, for example.

It is an object of the present invention to enable real-time cash management to be performed, even while the play of a game to be performed by employing gaming media recording information of which is readable.

A first aspect of the present invention is directed to a gaming system, comprising:

a first reader section for reading a first identifier recorded in a game medium, the first identifier identifying the game medium;

a value judgment section for judging a negotiable value indicated by the game medium, based upon the first identifier of the game medium read by the first reader section;

a first registration section for registering the negotiable value judged by the value judgment section and a second identifier, and the first identifier and the second identifier in association with each other, the second identifier identifying a person holding the game medium;

a game betting board;

a second reader section for respectively reading the first identifier of the game medium in a respective one of regions on the game betting board; and an update section for judging a change of the person holding the game medium, based upon reading of the first identifier in the respective one of the regions by the second reader section, and based upon the judgment, updating the registered information in the first registration section.

A second aspect of the present invention is directed to the gaming system of the first aspect, which may further comprises a game management section for managing game information on a game to be performed on the game betting board, wherein the update section judges a change of the person holding the game medium, based upon the game information managed by the game management section.

A third aspect of the present invention is directed to the gaming system of the first aspect, which may further comprises a second registration section having the first identifier and the negotiable value registered therein in association with each other, wherein: referring to the second registration section, the value judgment section judges the negotiable value registered in association with the first identifier of the game medium read by the first reader section; and the value judgment section, the first registration section, and the second registration section operate on a same server.

A fourth aspect of the present invention is directed to the gaming system of the first aspect, which may further comprises a deletion section for deleting the first identifier registered in the value judgment section if the value judgment section judges the negotiable value registered in association with the first identifier of the game medium.

A fifth aspect of the present invention is directed to the gaming system of the first aspect, which may further comprises a conversion section for converting each currency into a value of currency being a standard for a negotiable value of the game medium, based upon a current currency exchange rate.

A sixth aspect of the present invention is directed to the gaming system of the first aspect, which may further comprises a third registration section for registering the first identifier read by the first reader section in the first registration section, the first registration section registering the first identifier of the game medium in advance, if the first identifier read by the first reader section is not registered in the first registration section.

A seventh aspect of the present invention is directed to the gaming system of the first aspect, which may further comprises a deletion section for deleting the first identifier a term of validity of which has expired, from the second registration section, the second registration section registering the term of validity of the first identifier in association with the first identifier.

An eighth aspect of the present invention is directed to a gaming system, comprising:

a first storage device which stores first association information associating game medium identification information for identifying a game medium and holder identification information for identifying a holder holding the game medium with each other;

a game medium reader device which detects the game medium placed on a game betting board on which a game is to be played, the game betting board having a plurality of regions, and a region in which the game medium is placed, from among the plurality of regions, and generates detection information; and an update control device which, if it is judged based upon the detection information that the game medium is moved from a first region of the plurality of regions to a second region which is different from the first region, updates the holder identification information associated with game medium identification information of the moved game medium, from among the holder identification information of the first association information, wherein:

the first region is a region in which the game medium held by a first holder is to be placed; and the second region is a region in which the game medium held by a second holder who is different from the first holder is to be placed.

The "game medium identification information" corresponds to a chip ID. The "holder", "first holder", and "second holder" correspond to players or dealers, and the "holder identification information" corresponds to a card ID. The "first association information" corresponds to a game chip table, and the "first storage device" corresponds to an HDD54 of the server device 6. The "game betting board" corresponds to a game betting board 31, and the "game medium reader device" corresponds to a reader device 12. The "plurality of regions" correspond to regions (31), (32), (33), etc., shown in FIG. 8, and the "first region" and "second region" correspond to a chip holding position 32 and bet positions 33, etc., shown in FIG. 1. The "update control device" corresponds to a CPU 51 of a server device 6.

A ninth aspect of the present invention is directed to a gaming system, comprising:

a first storage device which stores first association information associating game medium identification information for identifying a game medium and holder identification information for identifying a holder holding the game medium with each other;

a second storage device which stores second association information associating negotiable value information for identifying a negotiable value of a game medium and the holder identification information of the holder holding the game medium with each other;

a third storage device which stores third association information associating negotiable value information of the game medium and the game medium identification information of the game medium with each other;

a game medium detection device which detects a game medium placed on a game betting board on which a game is to be played, the game betting board having a plurality of regions, and a region in which the game medium is placed, from among the plurality of regions, and generates the detected information; and an update control device which, if it is judged based upon the detected information that the game medium is moved from a first region of the plurality of regions to a second region which is different from the first region, updates the holder identification information associated with game medium identification information of the moved game medium, from among the holder identification information of the first association information, and further, reads out negotiable value information associated with game medium identification information of the moved game medium with reference to the third association information from the third storage device, and updates the negotiable value information associated with the game medium identification information of the moved game medium to the negotiable value information read out from the third storage device, from among the negotiable value information of the second association information, wherein:

the first region is a region in which a game medium held by a first holder is to be placed; and the second region is a region in which a game medium held by a second holder who is different from the first holder is to be placed.

The "game medium information" corresponds to a chip ID. The "holder", "first holder", and "second holder" correspond to players or dealers, and the "holder identification information" corresponds to a card ID. The "negotiable value information" corresponds to a cash type. The "first association information" corresponds to a game chip table; the "second association information" corresponds to a player table or a dealer table, and the "third association information" corresponds to a cash type table. The "first storage device", "second storage device", and "third storage device" correspond to the HDD54 of the server device 6. The "game betting board" corresponds to the game betting board 31, and the "game medium reader device" corresponds to the reader 12. The "plurality of regions" correspond to the regions (31), (32), (33), etc., shown in FIG. 8, and the "first region" and "second region" correspond to the chip holding position 32 or bet positions 33, etc. The "update control device" corresponds to the CPU 51 of the server device 6.

According to the first aspect of the invention, movement of a game medium, which is performed between a player and a game administrator in a game, and movement of a negotiable value of the game medium, are registered in a first registration section in real time, thus enabling real-time cash management to be performed in the game.

According to the second aspect of the invention, a variety of precision improvements in cash management in real time can be achieved in consideration of information on a game played on a game betting board.

According to the third aspect of the invention, a value judgment section, a first registration section, and a second registration section operate on a same server, so that, time for judging a negotiable value of a game medium from the first identifier based on a first identifier of a game medium can be reduced.

According to the fourth aspect of the invention, as to a game medium registered in a first registration section, once a negotiable value is judged, a first identifier is deleted from a second registration section, thus disabling use of a counterfeit game medium by not judging a negotiable value as to a game medium having a same first identifier.

According to the fifth aspect of the invention, a game medium can be imparted to a player requiring exchange for a game medium while showing foreign currency.

According to the sixth aspect of the invention, an old game medium a first identifier of which has already been deleted from the first registration section without being registered therein becomes available for use in a game.

According to the seventh aspect of the invention, the term of validity is provided for a respective one of game media, thus disabling use of a game medium the term of validity of which has expired.

According to the eighth aspect of the invention, the first association information is changed in real time, based upon movement of game media to be performed between players and dealers while in the play of a game, thus enabling cash management to be performed in real time while in the play of the game.

According to the ninth aspect of the invention, the first association information and the second association information are changed in real time, based upon movement of game media to be performed between players and dealers while in the play of a game and movement of negotiable values of these game media, thus enabling cash management to be performed in real time while in the play of the game.

BRIEF DESCRIPTION OF THE DRAWINGS

FIG. 11 is an illustrative view of a game chip table in the game management system according to one embodiment of the present invention;

FIG. 13 is an illustrative view of a dealer table in the game management system according to one embodiment of the present invention;

FIG. 14 is an illustrative view of a cash type table in the game management system according to one embodiment of the present invention;

DESCRIPTION OF THE PREFERRED EMBODIMENTS

Hereinafter, one embodiment of the present invention will be described.

Figure 1:
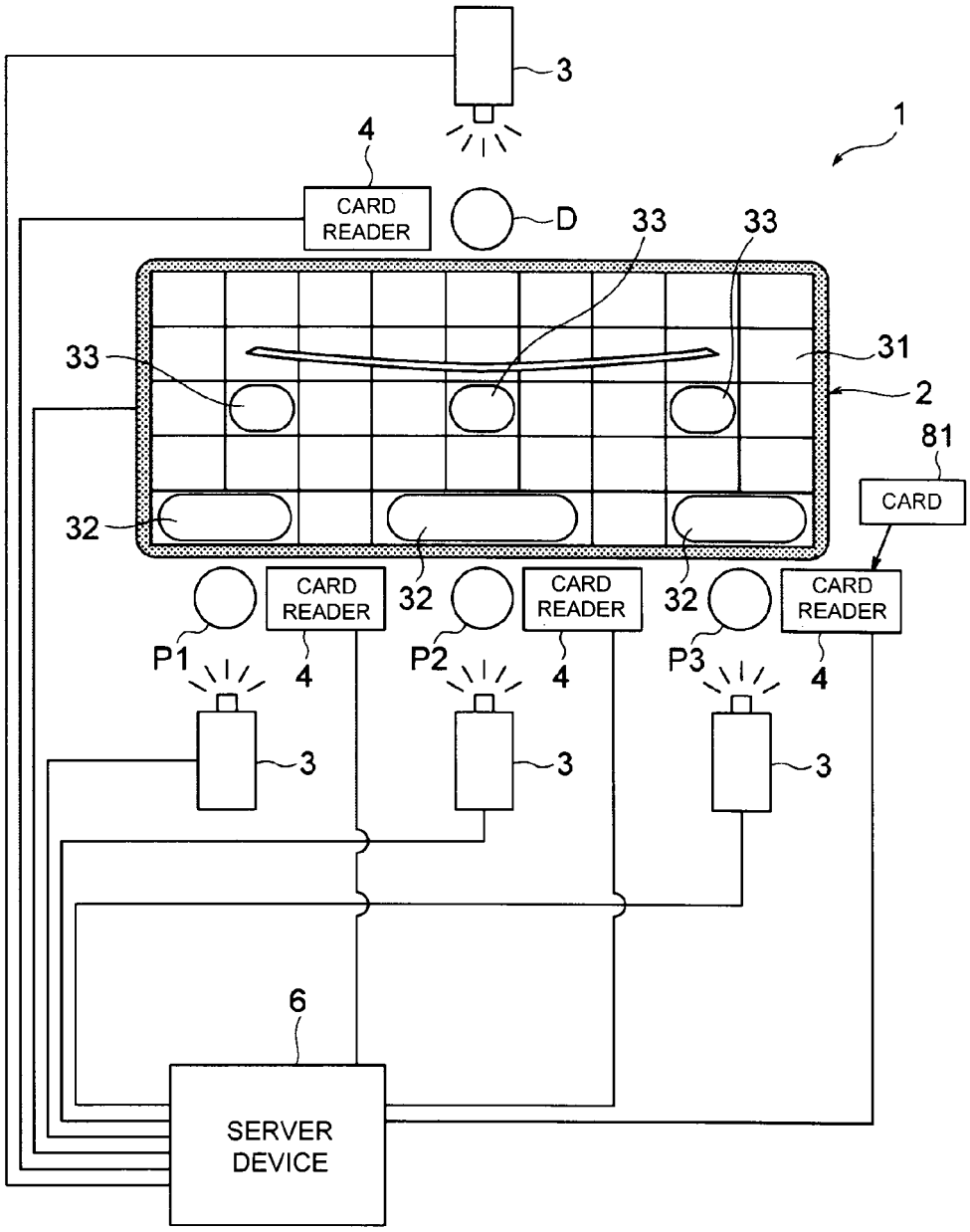
FIG. 1 is a block diagram depicting an entire configuration of a game management system according to one embodiment of the present invention.
Figure 2:
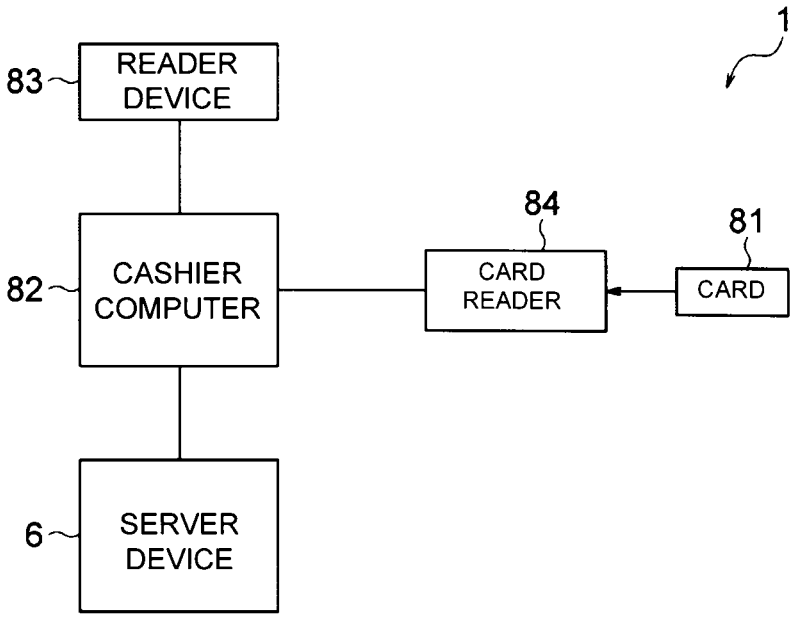
FIG. 2 is a block diagram depicting the entire configuration of the game management system according to one embodiment of the present invention.

FIGS. 1 and 2 are block diagrams each depicting an entire system configuration of a gaming system 1 according to this embodiment.

As shown in FIG. 1, the gaming system 1 is provided with a server device 6 for managing games. To the server device 6, a game betting device 2, a plurality of cameras 3, and a card reader 4 are connected via a predetermined communication interface (not shown). The gaming system 1 is installed in a casino hotel or the like, for example. The game betting device 2, the cameras 3, and the card reader 4 are installed in a game facility in this casino hotel, and the server device 6 is installed in a management room inside of the casino hotel.

The game betting device 2 is a device for betting game chips 71 (see FIG. 3) for performing games such as roulette and card games or the like in this embodiment. This game betting device 2 is provided with a game betting board 31. The game betting board 31 is a table for betting the game chips 71 on a top face thereof, and around the table, seats of a dealer D having way on games and players P1, P2, P3 participating in games are provided, respectively. (These seats are assigned by numerals 0 to 3.)

Players P1, P2, P3 play games while heaping up their own game chips 71 at chip holding positions 32, a respective one of which is located on one's own front face on a game betting board 31, and within the range of the vicinity of these positions. The players P1, P2, P3 bet their own chips by transferring them from the heaped up game chips 71 to the bet positions 33 which are located in front of their own chip heap-up positions 32, respectively. When results of the games are generated, the dealer D receives the game chips 71 from the bet positions 33, respectively, and from among them, the game chips 71 to be paid back to a player having won a game are placed at a front position of the player on the game betting board 31. The player receives the paid back game chips 71, and heaps up them at one's chip holding position 32.

The game betting device 2 reads information concerning wireless IC tags 72 of the game chips 71 placed on the game betting board 31, and transmits the information to the server device 6. Processing operations for reading and transmitting the information are periodically executed under the control of the server device 6, for example, every 5 seconds or every 10 seconds.

Cameras 3 are set at the seats of the dealer D and the players P1, P2, P3, respectively, on a one-by-one basis. These cameras 3 are used for the purpose of observing illegal act of the players or photographing cards in order to automatically recognize what kinds of cards the dealer and the players hold at hand in a card game.

Card readers 4 are installed in the corresponding seats of the dealer D and the players P1, P2, P3, respectively, on a one-by-one basis. These card readers 4 serve as devices for reading identification cards 81 owned by the dealer or the players. These identification cards 81 have card IDs for identifying the dealer or the players recorded therein. The players can make settlement at the time of playing games at the gaming machines in a casino or settlement at the restaurant in a hotel in which a casino is provided, by means of the identification cards 81. In addition, these identification cards are also used as keys for hotel rooms.

As shown in FIG. 2, a cashier computer 82 is provided in a cash exchange location in a casino or at the seat of the dealer D. The cashier computer 82 is connected to the server device 6 via a predetermined interface. A card reader 84 and a reader device 83 are connected to the cashier computer 82. The card reader 84 reads the identification card 81, and the read card ID is acquired by the cashier computer 82. The reader device 83 reads a wireless IC tag 72 (see FIG. 3) of a game chip 71, and then, the read information is acquired by the cashier computer 82. A camera 3 is provided in the vicinity of the cashier computer 82 as well, and the camera 3 is connected to the server device 6 via a predetermined interface.

Figure 3:
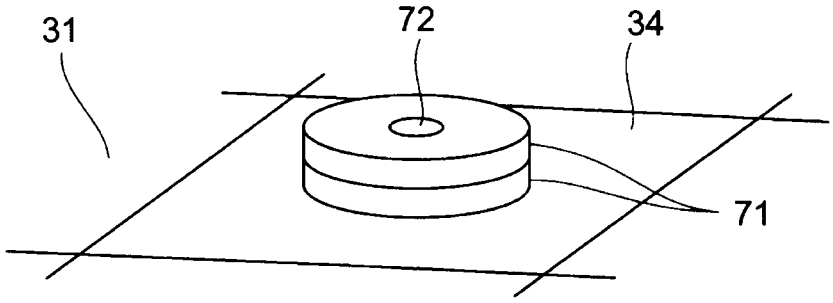
FIG. 3 is an illustrative view of game chips in the game management system according to one embodiment of the present invention.

FIG. 3 is an illustrative view of game chips used in games.

The wireless IC tag 72 is embedded in a respective one of the game chips 71, and in this wireless IC tag 72, only chip IDs which are different from each other, for identifying the game chips 71, are recorded. In addition, in a cash exchange location, in a case where the game chips 71 are paid out upon a player's request, the card IDs of the identification cards 81 that are owned by the players are registered in the server device 6 in order to associate the chip IDs with individual IDs for identifying the players simultaneously.

Next, a detailed construction of the game betting device 2 will be described.

Figure 4:
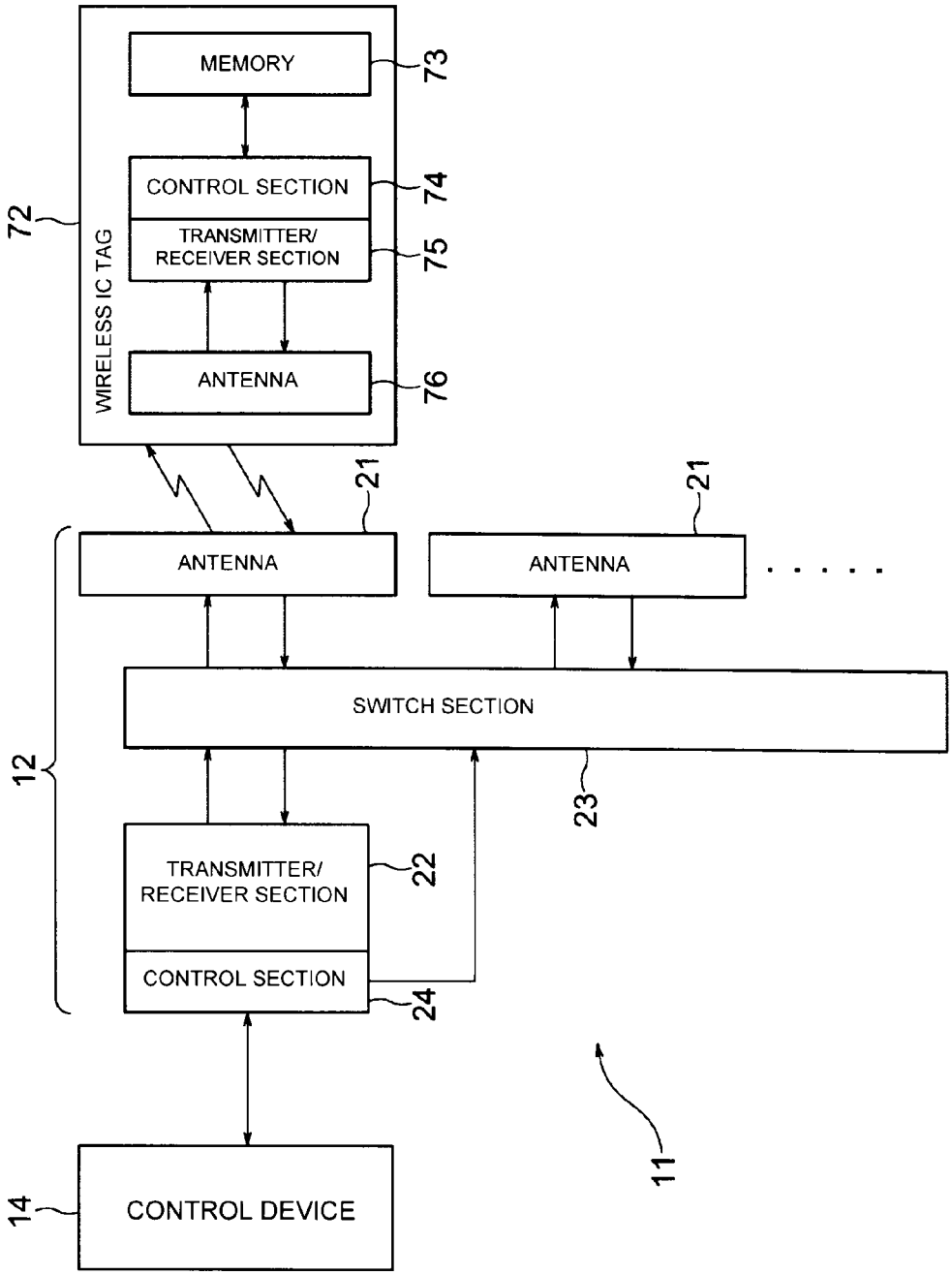
FIG. 4 is a block diagram depicting electrical connection of a bet information detection device in the game management system according to one embodiment of the present invention.

FIG. 4 is a block diagram depicting electrical connection of a bet information detection device 11. The bet information detection device 11 is a device for reading game chips 71 at the game betting device 2.

A control device 14 instructs the reader device 12 to generate a magnetic field to thereby cause the wireless IC tag 72 to generate electric power, and further, to read information recorded in the wireless IC tag 72 and transmit the data.

The reader device 12 is provided with: a plurality of antennas (loop antennas) 21; a transmitter/receiver section 22; a switch section 23; and a control section 24.

The control section 24 receives an instruction from the control device 14, and drives the transmitter/receiver section 22 and the switch section 23 in response to the received instruction.

The transmitter/receiver section 22 turns ON the power to the antennas 21 and generates a magnetic field for causing the wireless IC tag 72 to produce electric power. In other words, the antennas 21 are sequentially switched, allowing a magnetic field to be generated with respect to a respective one of the antennas 21. At the same time as when the magnetic field is generated, a load-modulated radio signal is demodulated by means of the transmitter/receiver section 22, thereby reading the information concerning the wireless IC tag 72. A respective one of the antennas 21 is provided for a respective one of the regions 34 that are provided on the game betting board 31.

The wireless IC tag 72 is a so called magnetic-field-type wireless IC tag, and is provided with: a memory 73; a control section 74; a transmitter/receiver section 75; and an antenna 76. The memory 73 is a storage device which stores a chip ID for specifying a game chip 71 (the number for identifying the game chip 71). In addition, the control section 74 interprets a command, a request, an instruction or the like, received from the reader device 12, and executes an operation in response thereto. The transmitter/receiver section 75 has a modulator section (not shown) and a demodulator section (not shown), and modulates/demodulates signals in order to communicate with the reader device 12. The antenna 76 feeds power to the transmitter/receiver section 75 by means of a magnetic field from the reader device 12, and receives a modulated wave from the transmitter/receiver section 75. This antenna then radiates the modulated wave in midair so as to allow the reader device 12 to receive it.

In this way, although the bet information detection device 11 is adapted to allow the wireless IC tag 72 to generate electric power and to read information concerning the wireless IC tag 72, by means of the antenna 21, these processing operations may be performed by means of separate antennas.

Next, the switch section 23 of the reader device 12 will be described.

Figure 5:
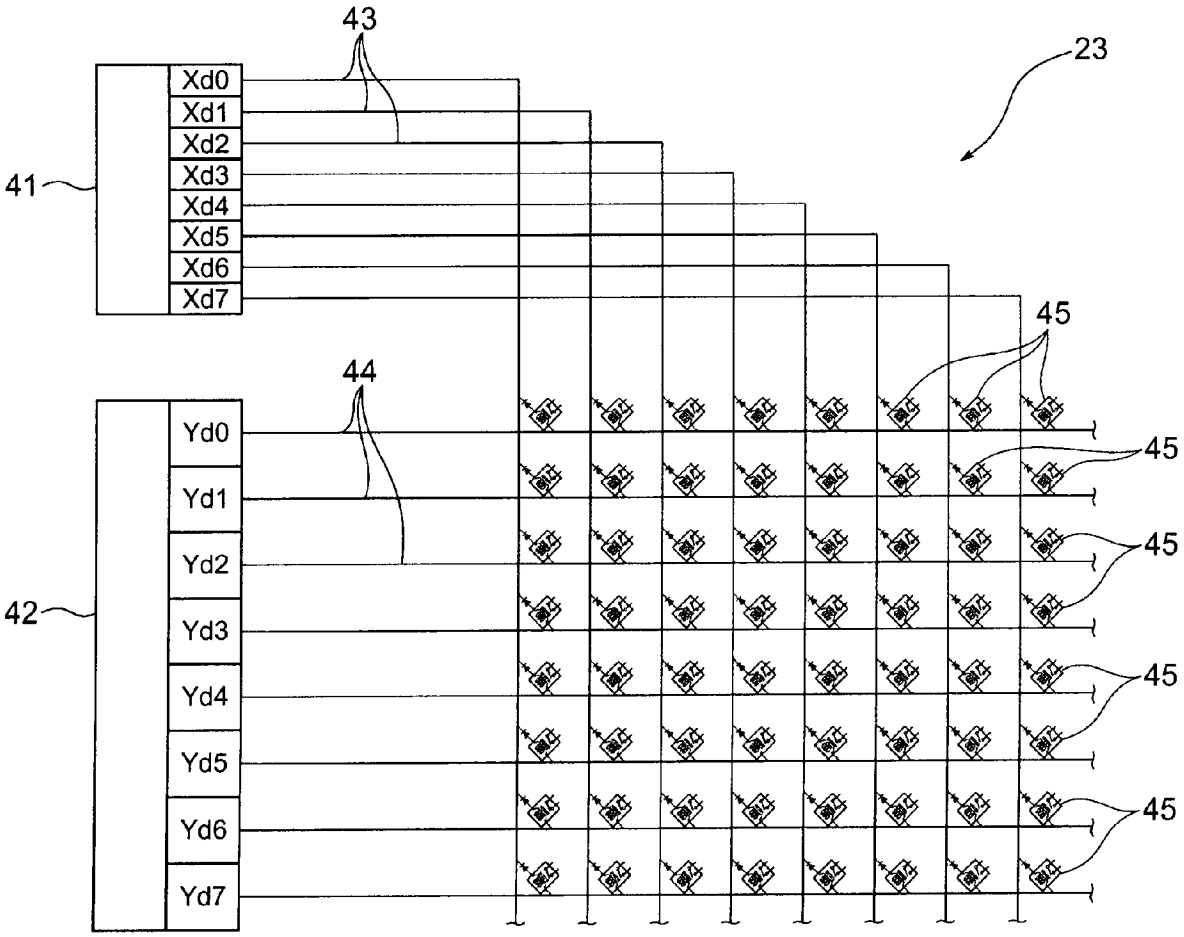
FIG. 5 is a circuit diagram illustrating a construction of a switch section in the game management system according to one embodiment of the present invention.
Figure 6:
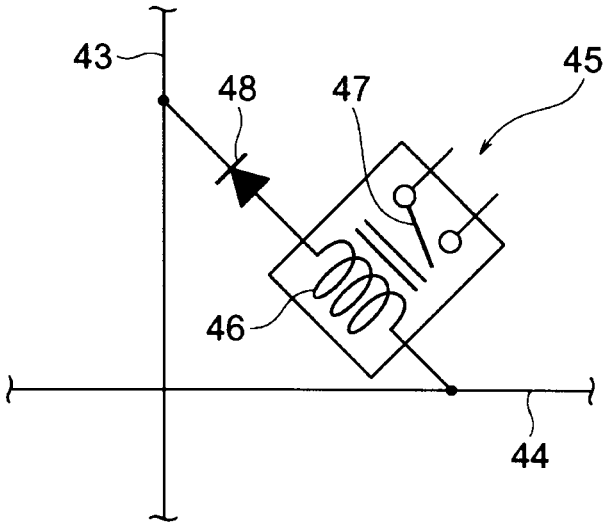
FIG. 6 is a circuit diagram illustrating the construction of the switch section in the game management system according to one embodiment of the present invention.
Figure 7:
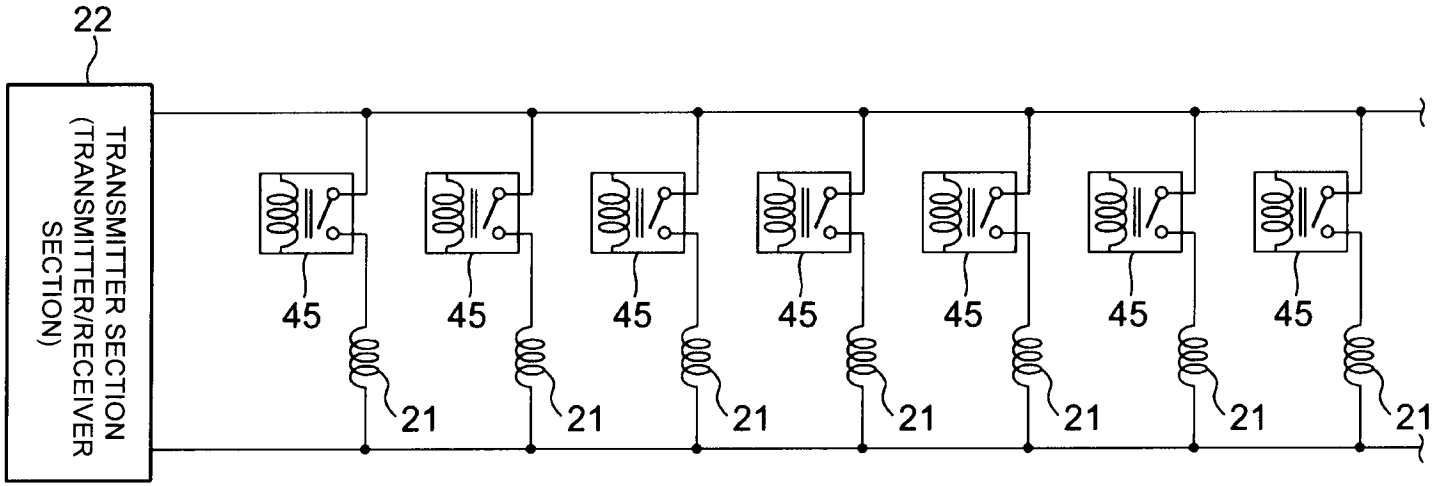
FIG. 7 is a circuit diagram illustrating still the construction of the switch section in the game management system according to one embodiment of the present invention.

FIGS. 5 to 7 are circuit diagrams each illustrating a construction of the switch section 23.

The switch section 23 is provided with an X-side scan driver 41 and a Y-side scan driver 42. A plurality of X-side transmission lines 43, which are parallel to each other, extend from the X-side scan driver 41. In addition, a plurality of Y-side transmission lines 44, which are parallel to each other, extend from the Y-side scan driver 42. One of two sets of the pluralities of the X-side and Y-side transmission lines 43 and 44 extends in a longitudinal direction, and the other one extends in a transverse direction, and these sets cross at a respective one of crossing points. In addition, relay circuits 45 are provided at such crossing points, respectively. The relay circuits 45 are connected to the X-side transmission lines 43 at one end of a coil 46 thereof, and are connected to the Y-side transmission lines 44 at the other end of the coil 46. A diode 48 is interposed at the side of the X-side transmission lines 43 of the coil 46 while the side of X-side transmission lines 43 serves as a cathode side and the side of the coil 46 serves as an anode side. In general, in a case where a respective one of the relay circuits 45 is turned OFF, a respective one of the X-side transmission lines 43 is maintained at an H level, and a respective one of the Y-side transmission lines 44 is maintained at an L level. In addition, when an attempt is made to turn ON a switch 47 of any one of the relay circuits 45, the X-side transmission line 43 to which a desired relay circuit 45 is connected at a crossing point thereof is switched to an L level, and the Y-side transmission line 44 to which the relay circuit is connected at a crossing point thereof is switched to an H level, similarly. In this manner, the coil 46 is powered ON, and the switch 47 is closed.

The relay circuits 45 of such type, as shown in FIG. 7, are provided in a respective one of the antennas 21, respectively, on a one-by-one basis. In other words, a respective one of the antennas 21 is serially connected to a respective one of the relay circuits 45, and if one of the relay circuits 45 is OFF, an antenna 21 which has been serially connected to the relay circuit 45 is not driven, or alternatively, if the relay circuit 45 turns ON, an antenna 21 which has been serially connected to the relay circuit 45 is driven. The relay circuit 45 of such type serves as a high-frequency relay.

Figure 8:
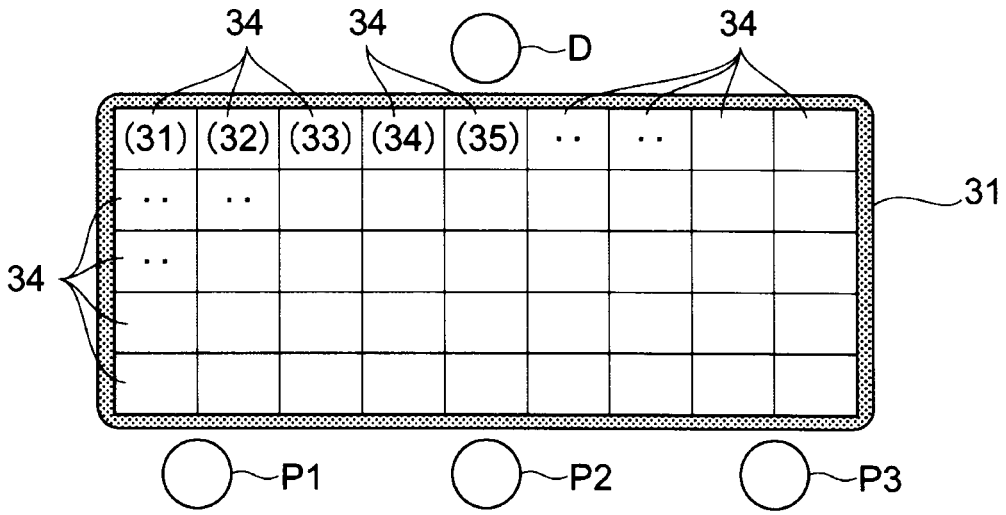
FIG. 8 is an illustrative view of a region provided on a game betting board in the game management system according to one embodiment of the present invention.

FIG. 8 is an illustrative view of a region provided on the game betting board 31.

A top of the game betting board 31 is divided by the regions 34. In an example of FIG. 8, these regions are assigned by numerals (31), (32), (33), . . . . A respective one of the antennas 21 is provided for a respective one of the regions 34 that are provided on the game betting board 31, thereby reading the information concerning the wireless IC tag 72 of a game chip 71 on a respective one of these regions 34. Afterwards, the antennas 21 in all of the regions 34 are sequentially driven on a one-by-one basis in sequential order of the regions 34 assigned by numerals (31), (32), (33), . . . , and the wireless IC tags 72 of the game chips 71 that are placed on the regions 34 are sequentially read, thereby making it possible to read the wireless IC tags 72 of all of the game chips 71 that are present on the regions 34 on the game betting board 31. In this case, even if a plurality of game chips 71 are heaped up on any one of the regions 34, the wireless IC tags 72 of all of the game chips 71 can be read.

Next, a construction of the server device 6 will be described.

Figure 9:
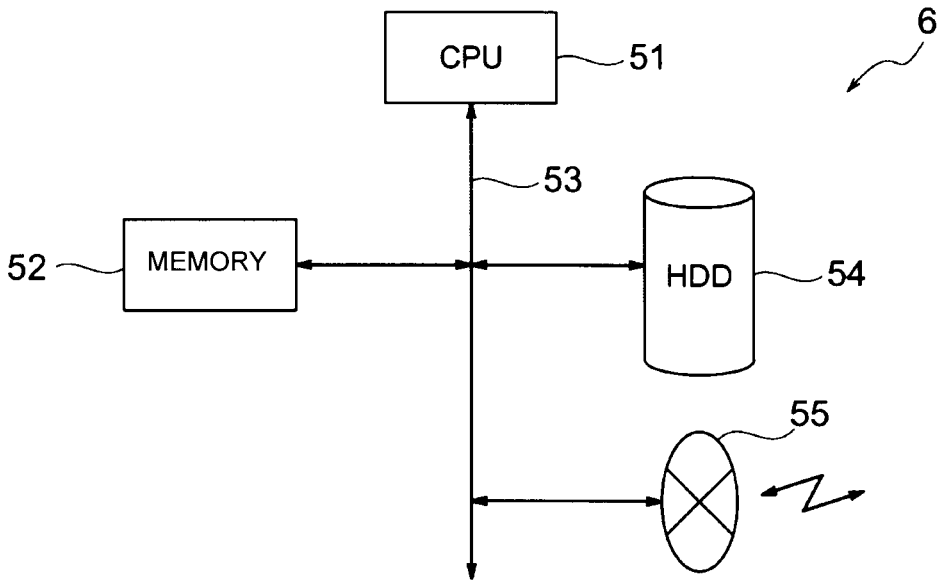
FIG. 9 is a block diagram depicting electrical connection of a server device in the game management system according to one embodiment of the present invention.

FIG. 9 is a block diagram depicting electrical connection of the server device 6.

In the server device 6, a CPU 51, which performs a variety of computations and intensively controls processing sections, and a memory 52, which is made up of a variety of RAMs and/or ROMs, are connected via a bus 53. To the bus 53, a magnetic storage device 54 for storing a variety of programs or fixed data and the like; and a communication interface (I/F) 55 communicating with (a control device 14) of the game betting device 2, a cashier computer 82, a camera 3, a card reader 4 or the like, are connected via a predetermined interface.

Next, a construction of the cashier computer 82 will be described.

Figure 10:
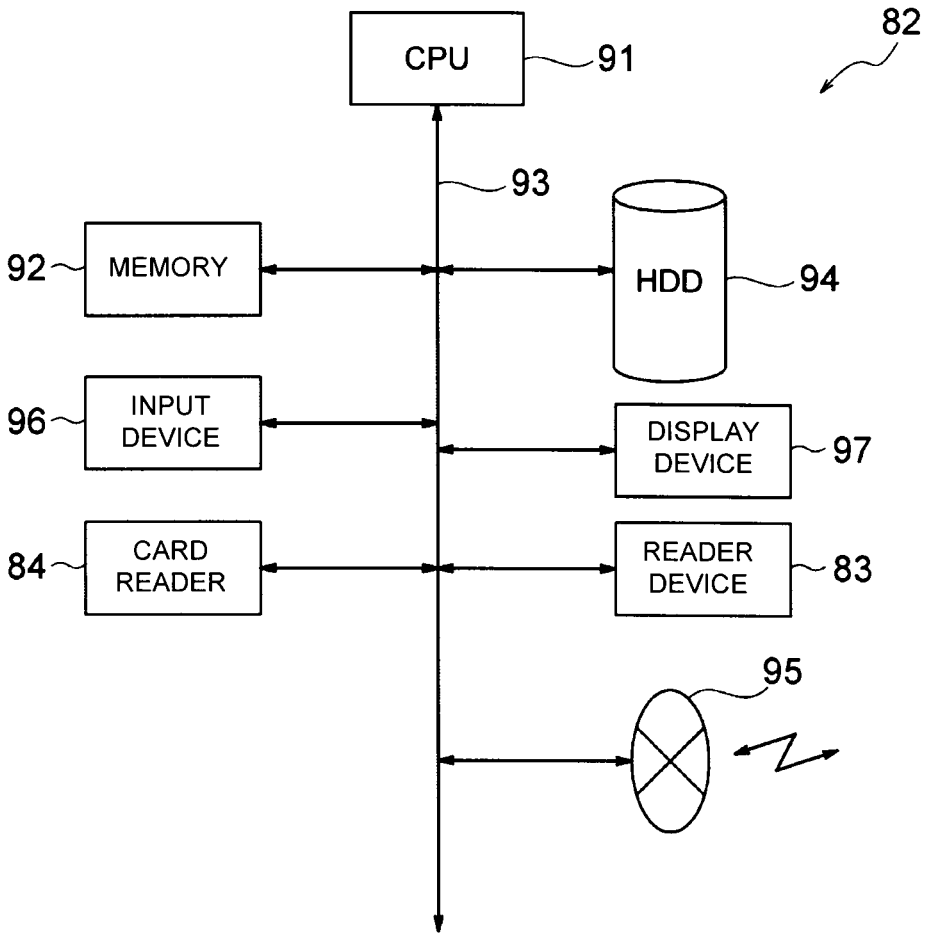
FIG. 10 is a block diagram depicting electrical connection of a cashier computer in the game management system according to one embodiment of the present invention.

FIG. 10 is a block diagram depicting electrical connection of the cashier computer 82.

In the cashier computer 82, a CPU 91, which performs a variety of computations and intensively controls processing sections, and a memory 92, which is made up of a variety of RAMs and/or ROMs, are connected via a bus 93. To the bus 93, a magnetic storage device 94 for storing a variety of programs, fixed data or the like; an input device 96 such as a keyboard, a mouse or the like; a display device 97; a card reader 84; a reader device 83; and a communication interface (I/F) 95 which makes communication with a server device 6 are connected via a predetermined interface.

Next, configurations of a variety of tables stored in the server device 6 will be described.

FIG. 11 is an illustrative view of a game chip table stored in the server device 6.

A game chip table 111 is a table for managing all of the game chips 71 that are used in a casino. In other words, all of chip IDs of all of the game chips 71 that are used in a casino are registered in the game chip table 111. A card ID of an identification card 81 can be registered in association with a respective one of the chip IDs. In addition, a respective one of the terms of validity, which is a period of time that the game chips 71 identified by the chip IDs are available, can be registered in association with these chip IDs.

Figure 12:
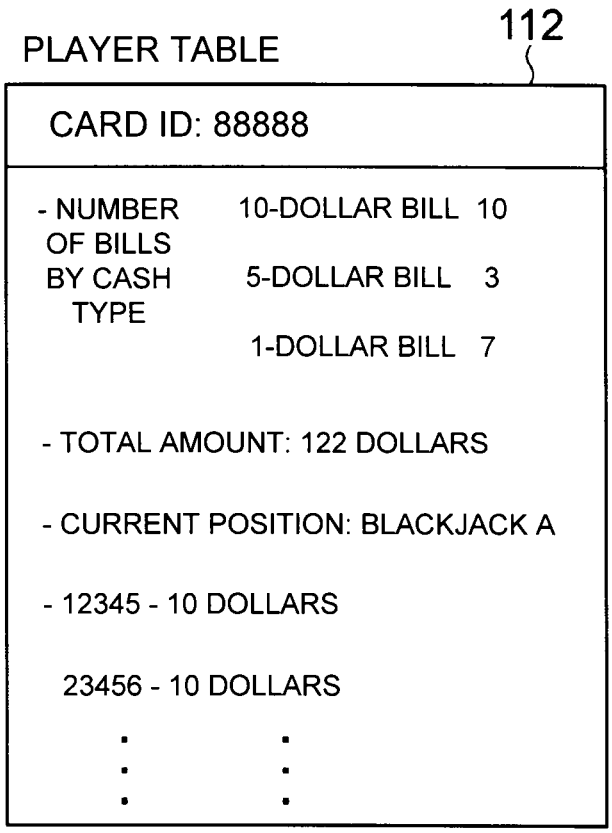
FIG. 12 is an illustrative view of a player table in the game management system according to one embodiment of the present invention.

FIG. 12 is an illustrative view of a player table stored in the server device 6.

A player table 112 is provided on a one-by-one player basis, and data relevant to the number of bills by cash types (such as 10-dollar bills, 5-dollar bills, 1-dollar bills) is registered for all of the game chips 71 that are currently owned by the players. In addition, data relevant to a "total amount", indicative of a total amount of negotiable values of all of the game chips 71, is registered. Further, data relevant to "current position(s)" of the players is also registered. In other words, a variety of games are played in a casino; and therefore, the "current position" data indicates which Game Corner the player is currently playing games in. In addition, a respective one of chip IDs, which is registered in the game chip table 111 in association with the card IDs of the players, is registered in association with negotiable values of the chip IDs, respectively.

FIG. 13 is an illustrative view of a dealer table which is stored in the server device 6.

A dealer table 113 is provided on a one-by-one dealer basis, and data relevant to the number of bills by cash types (such as 10-dollar bills, 5-dollar bills, 1-dollar bills) is registered for all of the game chips 71 that are currently owned by the dealers. In addition, data relevant to "a total amount", which is indicative of a total amount of negotiable values of all of the game chips 71, is registered. Further, data relevant to "current position(s)" of the dealers is also registered. In other words, a variety of games are played in a casino; and therefore, the data relevant to "current position (s)" indicates which Game Corner the dealer is currently responsible for having way on games in. In addition, a respective one of chips IDs, which is registered in the game chip table 111 in association with the card IDs of the dealers, is registered in association with the negotiable values of the chip IDs. A cashier table is provided for a cashier computer 82 in a cash exchange location, and a construction of this table is similar to that of the player table except that the data relevant to "current location(s)" has not been registered. An illustration or a detailed description thereof is omitted.

FIG. 14 is an illustrative view of a cash type table stored in the server device 6.

A cash type table 114 is a table for, with respect to all of the game chips 71 used in a casino, judging cash types of negotiable values thereof. In the cash type table 114, chip IDs are registered for all of the game chips 71 used in a casino, and items of information concerning cash types (such as 10-dollar bills, 5-dollar bills, 1-dollar bills), which are set for the game chips 71 of the chip IDs, are registered in association with the chip IDs, respectively.

Next, specific processing operations to be performed using the gaming system 1 will be described.

Figure 15:
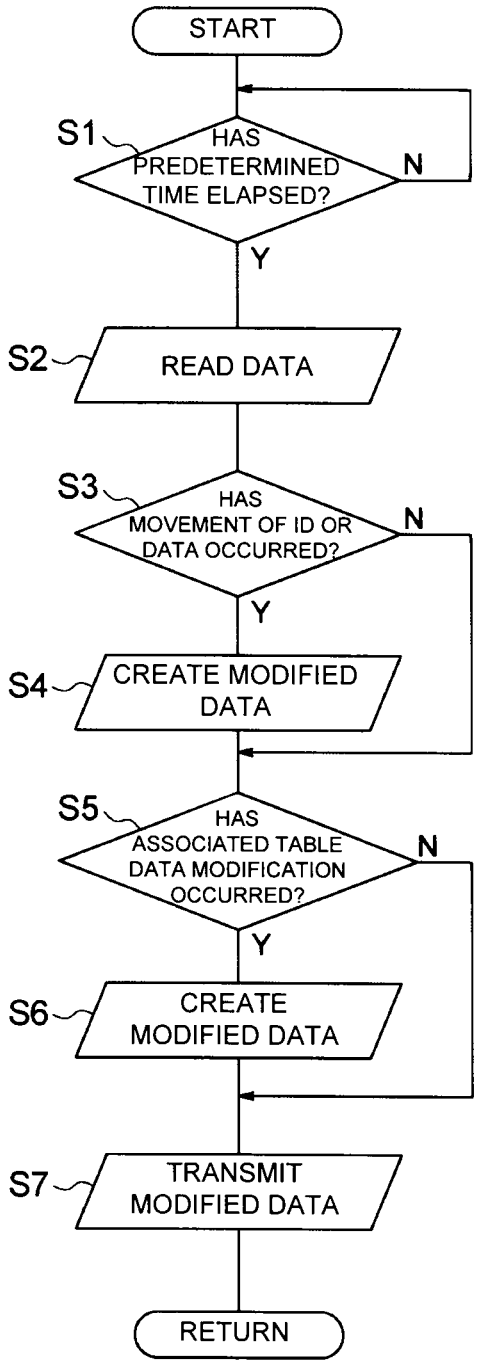
FIG. 15 is a flowchart of operation to be performed in the game management system according to one embodiment of the present invention.

First of all, processing operations to be executed by means of the cashier computer 82 that is provided in a cash exchange location or at a dealer's seat will be described. FIG. 15 is a flowchart of processing operations to be executed by the cashier computer 82 and the game betting device 2.

After a predetermined time has elapsed (after Y of step S1), the cashier computer 82 and the game betting device 2 read the data inputted within the predetermined time (step S2). If movement of an ID or data occurs in these items of data (after Y of step S3), modified data relevant to the movement is created (step S4). In addition, if modification of the data relevant to any of the aforementioned tables associated with the cashier computer 82 occurs in these items of data (after Y of step S5), modified data relevant to such modification is created (step S6). In addition, these items of the modified data are transmitted to the server device 6 (step S7). This data transmission process is performed even if such modified data is absent.

Figure 16:
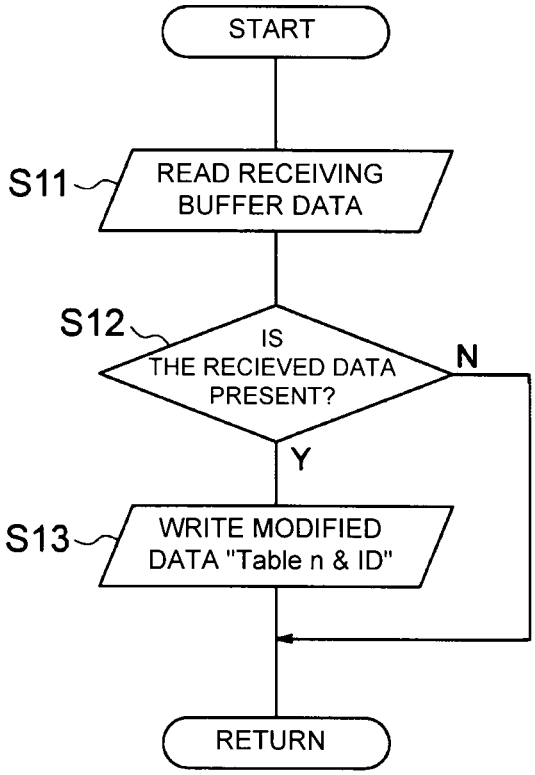
FIG. 16 is a flowchart of operation to be performed in the game management system according to one embodiment of the present invention.
Figure 17:
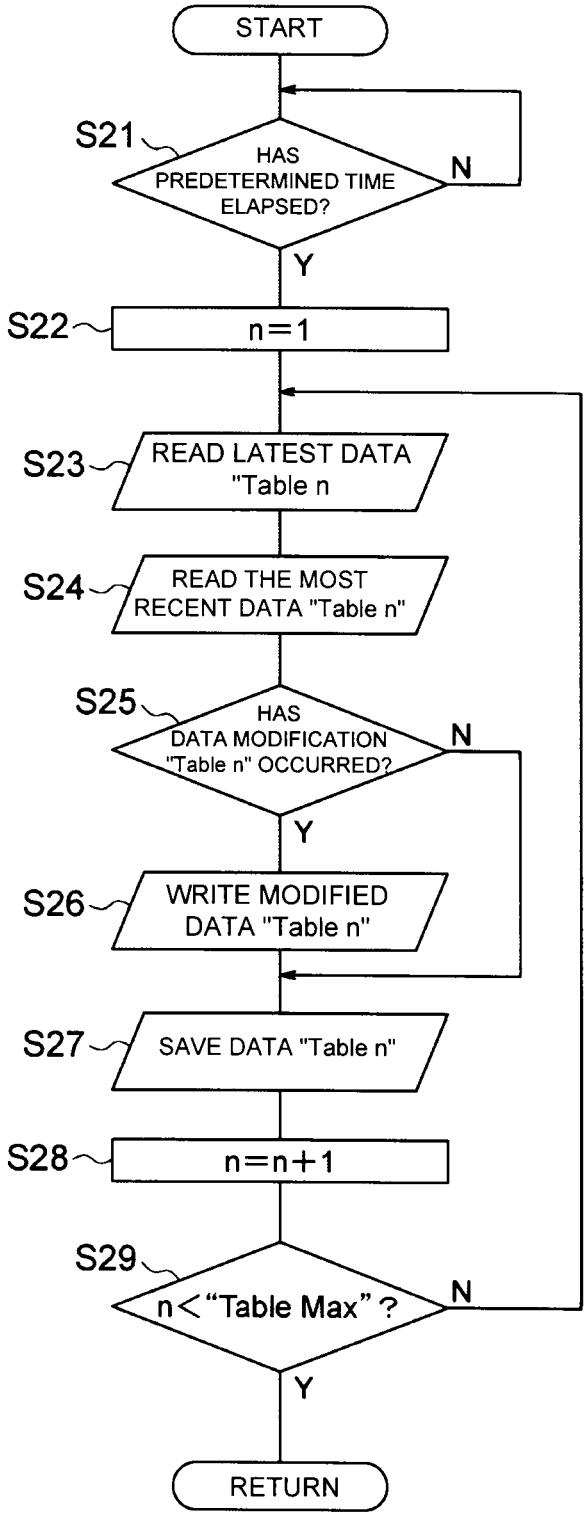
FIG. 17 is a flowchart of operation to be performed in the game management system according to one embodiment of the present invention.

FIGS. 16 and 17 are flowcharts of processing operations to be executed by the server device 6.

First, the data transmitted from the cashier computer 82 at step S7 enters a receiving buffer of the server device 6, and after the data having entered the receiving buffer has been read (after Y of step S11), if received data is present (after Y of step S12), the modified data is acquired, and the acquired data is then written in a magnetic storage device 94 or the like (step S13).

After a predetermined period of time has elapsed (after Y of step S21), the server device 6 sets a value of "n" to a default value 1 (n=1) (step S22). This value of "n" is a number which is set for a respective one of the aforementioned tables. For example, the game chip table 111, the player table 112, the dealer table 113, the cash type table 114, and the cashier table (not shown) are assigned by numerals 1, 2, 3, 4, and 5, respectively. Hereinafter, a table whose number is "n" is referred to as a table "n".

The latest data and/or the most recent data relevant to table "n", are/is then read from the data written at step S13 (steps S23, S24). If modified data is present for the table "n" from these items of the read data (after Y of step S25), the modified data is written in the table "n" (step S26). Afterwards, data relevant to the table "n" is saved (step S26). This data saving allows the data to be continuously stored together with time information so as to enable data referencing in a chronological manner. Further, if the value of "n" fails to reach a maximum value, i.e., Table Max ("5" in the example mentioned previously) after +1 has been added to the value of "n" (step S27), the routine reverts to step S23.

Next, a specific description of processing operations, which are achieved by the processing operations of FIGS. 15 to 17, will be described in a chronological manner.

Players, who attempt to play games in a casino, exchange cash for game chips 71 in a cash exchange location. (Of course, settlement may be performed by means of credit cards or the like.) A responsible person in the cash exchange location receives an identification card 81 from a respective one of the players; sets the card at a card reader 84; and sets the game chips 71 to be delivered to the corresponding player, at the reader device 83.

When the responsible person operates a cashier computer 81 in the above-described state, and then, selects a processing operation of lending game chips, the cashier computer 81 reads a card ID of the identification card 81 by means of the card reader 84, and then, reads chip IDs of the game chips 71 by means of the reader device 83. Afterwards, information concerning the card ID and chip IDs is transmitted to a server device 6 at step S7.

Having received the information concerning the card ID and chip IDs, the server device 6 searches a game chip table 111 by means of a respective one of the received chip IDs, in accordance with the processing operations of FIG. 17, and then, registers the received card IDs in association with the searched respective one of chip IDs of the game chip table 111, respectively. In this manner, the game chips 71 delivered to the player in the cash exchange location and the player having received the game chips 71 are registered in association with each other.

Next, a cash type table 114 is searched by means of the received respective one of chip IDs; the cash types of the chip IDs are specified; and the number of game chips 71 for each cash type and a total amount of negotiable values of all of the game chips 71 are judged. In this case, data of the chip IDs, having been searched by means of the cash type table 114, may be deleted from the cash type table 114. Next, if a player table 112 of the player of that card ID is present, "the number" of game chips 71 and a "total amount" thereof are recorded in that player table 112. If not, a new player table 112 is created, and a "card ID", "the number" of chips, and a "total amount" thereof are recorded in the table.

A player having the game chips 71 at hand takes a seat, facing one of the Game Corners of game machines, where the player desires to play game(s). For example, when a player desires to play a roulette game, the player takes a seat in a Roulette Game Corner, and when a player desires to play a blackjack game, the player takes a seat in a Blackjack Game Corner. Then, the player sets one's own identification card 81 at the card reader 4 placed at the seat.

Next, processing operations, to be performed by means of the server device 6 when the identification card 81 is set at the card reader 4, will be described.

When the identification card 81 has been read by means of any card reader 4, which one of the seats the player is taking in which one of the Game Corners is specified from a device number of the card reader 4, each player table 112 is searched by means of the card ID of the read identification card 81, and the type of the specified Game Corner at step S22 is registered in a "current position" of the player table 112 in which the card ID is registered. In this manner, it is possible to specify which one of the players is playing game(s) in which one of the Game Corners.

When it is recognized that the identification card 81 has been removed from any one of the card readers 4, which one of the seats the player is taking in which one of the Game Corners is specified from a device number of the card reader 4 at which the removed identification card 81 has been set; each player table 112 is searched by means of the card ID of the removed identification card 81, and the "current position" is deleted from the player table 112 in which the card ID is registered.

In this way, the players, having taken the seats in a given Game Corner of the gaming machines, start games. At this time, the players and the dealers also play games by heaping their own game chips 71 on the game betting board 31.

As described previously, the game betting device 2 reads information concerning the wireless IC tag(s) 72 of the game chip(s) 71 that is(are) placed on the game betting board 31, and transmits the read information to the server device 6. This information reading and transmission processes are periodically executed under the control of the server device 6 every 5 seconds, every 10 seconds or the like, for example. The transmitted data is sequentially recorded in the server device 6.

Afterwards, as to the game chips 71 on the game betting board 31, the progress of a game can be detected in accordance with which one of the game chips 71 has been detected in which one of the regions 31. In other words, it is identified that the players still hold the game chips 71 having been detected at the chip holding positions 32 of the players and within the range of the vicinity of these positions.

Next, it is possible to judge in real time whether or not the game chips 71 detected at the bet position 33 have been betted by an authorized player, from the card ID associated with the chip IDs. This judgment is made by referring to the game chip table 111 on the server device 6. At the same time, it is possible to judge in real time whether the detected chips are to be continuously owned by that player or to be collected due to a loss of the game. This judgment is based upon the results of games observed on the server device 6.

Further, it is identified that the game chips detected in the vicinity of a dealer's seat are held by the dealer's side as well, by referring to the game chip table 111 on the sever device 6.

If payments to players are determined as the result of a game, the dealer assigns the corresponding game chips 71 to the players as a payment from among their own game chips 71. At this time, the card ID indicative of an owner on the game chip table 111 is changed as to the game chips 71 that have been actually physically moved as a payment by the dealer. In this case also, on the server device 6, an amount of payment to be made based upon the result of a game is identified; and therefore, in the case where the dealer mistakenly or intentionally attempts to assign a wrong amount of payment, the fact can be recognized on the server device 6 immediately. In such a case, the above dealer's attempt may be displayed on the display device on the game betting board 31.

Further, the wins or losses of the games played by the players are visually observed as follows. In the case of a card game, for example, kinds of cards at hand are recognized by means of image recognition, through an image of a camera 3 which is installed for a respective one of the players, and the progress of the game is transmitted to the server device 6 in real time. The server device 6 judges the win or loss of the game, based upon data relevant to the progress of the game, which is transmitted in real time; automatically computes an amount of payment relative to a total amount of betted game chips 71 which are identified by the aforementioned means; and updates the player table 112, the dealer table 113, and the game chip table 111 on the server device 6 in real time, based upon the result of the game. In addition, the server device 6 allows the display device to display the result of the game on the game betting board 31 as required.

In the case of another game such as a roulette game, which one of the pockets a roulette ball has rolled-in is detected by means of another electromagnetic sensor or optical means provided on a roulette board, and the result of the detection is transmitted to the server device 6 in real time. Further, payment to the players is automatically computed from the positions of game chips 71 on the game betting board 31, which have been detected in advance and recorded in the server device 6; and the player table 112, the dealer table 113, and the game chip table 111 on the server device 6 are updated immediately. In this case also, the server device 6 allows the display device to display the result of payment on the game betting board 31 as required.

The game chips 71, which are placed on the dealer's side, are paid to the player(s) as a payment according to the result of the game, whereas it is possible to immediately make a check, if an error has occurred with the payment, by allowing the server device 6 to detect movement of the game chips 71 in real time. In this case also, the display device allows the result of payment to be displayed on the game betting board 31 as required.

In addition, the server device 6 allows an electromagnetic sensor, camera 3 or the like, which is installed in the game betting board 31, to recognize the progress of the game in real time, and then, based upon the result of the game, updates the player table 112, the dealer table 113, and the game chip table 111 in real time. Further, this server device 6 detects the game chips 71 to be actually moved (including those betted by the players and/or those paid from the dealer as a payment), in real time, and checks whether or not any mistake occurs, in real time, in the light of the result of the game.

Games are played as described above, during which the data relevant to the game chip table 111, the player table 112, and the dealer table 113 are serially updated, enabling real-time cash management to be performed in the play of the game.

In addition, the game chip table 111, the player table 112 and the dealer table 113, and the cash type table 114 for judging the negotiable values of game chips 71 operate on the same server device 6, thus enabling reduction of time for judging the negotiable value of a respective one of the game chips 71.

The embodiment is directed to a system of keeping track of chip IDs of all of the game chips 71 in real time, together with player information and dealer information. In this system, in a case where game chips of the same chip IDs have been used on another different game betting board 31, the fact is recognized immediately, and can also be detected as an error, thus disabling use of counterfeit game chip(s).

A player, who attempts to terminate games in progress at one of the game machines in a given Game Corner of the game machines, removes one's own identification card 81 from the card reader 4.

Further, a player, who terminates all of the games in a casino, exchanges game chips 71 for cash at a cash exchange location. The responsible person in the cash exchange location receives an identification card 81 from the player, sets the received card at the card reader 84, and then, sets game chips 71 to be delivered to the player, at the reader device 83.

Next, processing operations, to be performed by means of the cashier computer 82 and the server device 6 in the abovementioned case, will be described.

When the responsible person operates the cashier computer 82 in the state in which the game chips are set, and then, selects a processing operation of exchanging game chips, the cashier computer 82 allows the card reader 84 to read the card ID of the identification card 81 and the reader device 83 to read the chip IDs of the game chips 71. Afterwards, the items of information concerning the card ID and the chip IDs are transmitted to the server device 6 at step S7.

Having received the information concerning the card ID and the chip IDs, the server device 6 searches the game chip table 111, by means of the received chip IDs, in accordance with the process of FIG. 17, and then, deletes the card ID registered in associated with a respective one of the chip IDs searched in the game chip table 111. In addition, this server device 6 searches the player table 112 of the player by means of the card ID, and deletes the player table 112.

Next, another processing operation to be performed while in the play of a game will be described.

First, exchanging cash for game chips 71 may be conducted not only in the cash exchange location, but also with a dealer. In other words, the cashier computer 82 is placed in the cash exchange location as well as at the dealer's seat, and the dealer can perform the aforementioned processing operations relating to the cashier computer 82 by operating the cashier computer 82. In this case, the dealer responds to provision of game chips 71 by each currency other than dollars being a standard for negotiable values of game chips 71.

Next, processing operations, to be performed in the case where the dealer's attempts to exchange currency other than dollars for chips, will be described.

The server 6 always holds the latest information on currency exchange rates relating to each currency. The dealer then selects information concerning currency exchange rates by operating the cashier computer 82, whereby the cashier computer 82 transmits a query to the server device 6 at step S7. The server device 6 having received the query transmits the latest information concerning currency exchange rates to the cashier computer 82. The cashier computer 82 having received the above transmitted information allows a display device 97 to display the latest information concerning currency exchange rates.

In this manner, the dealer can respond to a request for exchange currency other than dollars for game chips 71, if any.

In addition, there may be a case in which a player attempts to show and use game chips 71 which were available for use in the casino in the past, but is currently unavailable.

Next, processing operations, to be performed in the case where the above player's attempt is made, will be described.

Since, in this case, no chip ID is registered in the game chip table 111 and the cash type table 114, it is impossible to perform processing operations such as that of registering a card ID in association with a chip ID, and then, judging the number of game chips 71 and a total amount thereof, or the like. Therefore, the server device 6 judges that a chip ID which is not registered in the game chip table 111 or the cash type table 114 has been transmitted from the cashier computer 82; indicates the chip ID; and notifies to the cashier computer 82 that the chip ID has not been registered in the game chip table 111 and/or the cash type table 114. In the cashier computer 82 having received this notification, the responsible person in the cash exchange location can specify that chip ID and performs an operation of new registration processing.

The operation of new registration processing is performed by specifying the chip ID and specifying a cash type of a game chip 71 of the chip ID. If this new registration processing is performed, a request for new registration processing is transmitted to the server device 6, together with items of information concerning chip IDs and cash types at step S7. Having received this request for new registration processing, the server device 6 registers the chip ID in the game chip table 111 and/or the cash type table 114. In this case, the chip ID and the specified cash type are registered in association with each other in the cash type table 114.

In this manner, old game chips 71 or the like, which are brought into casino(s) by the players and the registration of which already are deleted from the server device 6, are adapted to be available for use in games.

Next, another process to be executed by the server device 6 will be described.

The server device 6 performs the above process once a day, for example, during a predetermined time prior to opening casino(s). In other words, if the predetermined time has been reached, it is judged whether or not there is a chip ID the term of validity of which has expired, referring to the term of validity of a respective one of the chip IDs in the game chip table 111 and/or the cash type table 114. If there is a chip ID the term of validity of which has expired, the chip ID is deleted from the game chip table 111 and/or the cash type table 114.

In this manner, it becomes possible to provide the gaming chips 71 with terms of validity, respectively, and to disuse the gaming chips 71 terms of validity of which having expired.

As described previously, once the negotiable value of game chips 71 contained in the cash type table 114 is judged (once the game chips 71 are exchanged for cash), data relevant to a chip ID of the game chip 71 is deleted from the cash type table 114. Afterwards, the game chip 71 having the same chip ID cannot be used in a game, since it is impossible to judge a cash type of the chip. In this manner, use of counterfeit game chips may be disabled.

What is claimed is:

1. A gaming system, comprising:

a first storage device which stores a first association table defining first association information associating game medium identification information for identifying a game medium and holder identification information for identifying the holder holding a game medium with each other;

a second storage device which stores a second association table defining second association information associating negotiable value information for identifying a negotiable value of the game medium and the holder identification information of the holder holding the game medium with each other;

a third storage device which stores a third association table defining third association information associating negotiable value information of the game medium and the game medium identification information of the game medium with each other;

a game medium detection device which detects the game medium placed on a game betting board on which a game is to be played, the game betting board having a plurality of regions, and a region in which the game medium is placed, from among the plurality of regions, and generates detection information; and an update control device which, if it is judged based upon the detection information that a game medium is moved from a first region of the plurality of regions to a second region which is different from the first region, updates the holder identification information associated with the game medium identification information of the moved game medium, from among items of the holder identification information of the first association information, and further, reads out the negotiable value information associated with the game medium identification information of the moved game medium with reference to the third association information from the third storage device, and updates the negotiable value information associated with the game medium identification information of the moved game medium to the negotiable value information read out from the third storage device, from among items of the negotiable value information of the second association information, wherein the first region is a region in which a game medium held by a first holder is to be placed, and the second region is a region in which a game medium held by a second holder who is different from the first holder is to be placed.

2. The gaming system according to claim 1, further comprising:

a game management section that manages game information on the game to be performed on the game betting board, wherein the update control device judges a change of a person holding the game medium based on the game information managed by the game management section.

3. The gaming system according to claim 1, wherein the update control device, the first storage device, the second storage device, and the third storage device operate on a same server.

4. The gaming system according to claim 1, further comprising:

a conversion section that converts each currency into a value of currency being a standard for the negotiable value of the game medium based on a current currency exchange rate.

5. The gaming system according to claim 1, further comprising:

a registration section that registers the detection information detected by the game medium detection device in the first association table if the detection information detected by the game medium detection device is not defined in the first association table.

6. The gaming system according to claim 1, further comprising:

a deletion section that deletes the game medium identification information for identifying a game medium a term of validity of which has expired, from the first association table, the first association table defining the term of validity of the game medium identification information for identifying the game medium in association with the game medium identification information for identifying the game medium.

* * * * *